US006019105A

United States Patent [19]

White

[11] Patent Number: 6,019,105

[45] Date of Patent: Feb. 1, 2000

[54] TOBACCO PROCESSING METHOD AND APPARATUS

[75] Inventor: Victor Albert Montgomery White, Finmere, United Kingdom

[73] Assignee: GBE Internatinal PLC, Hampshire, United Kingdom

[21] Appl. No.: 08/860,443

[22] PCT Filed: Apr. 4, 1996

[86] PCT No.: PCT/GB96/00851

§ 371 Date: Jun. 26, 1997

§ 102(e) Date: Jun. 26, 1997

[87] PCT Pub. No.: WO96/31134

PCT Pub. Date: Oct. 10, 1996

[30] Foreign Application Priority Data

Apr. 5, 1995 [GB] United Kingdom ..... 9507074

[51] Int. Cl.[7] ..... A24B 1/02; D01G 15/00; D01G 15/02

[52] U.S. Cl. ..... 131/109.1; 19/98; 19/101; 131/109.2; 131/321

[58] Field of Search ..... 131/109.1, 909, 131/109.2, 110, 321; 19/98, 101

[56] References Cited

U.S. PATENT DOCUMENTS 255,494 3/1882 Curtis et al. ..... 131/109.1

FOREIGN PATENT DOCUMENTS 367431 2/1932 United Kingdom .

2246502 5/1992 United Kingdom .

*Primary Examiner*—James Derrington

*Assistant Examiner*—Dionne A. Walls

*Attorney, Agent, or Firm*—Pollock, Vande Sande & Amernick

[57] ABSTRACT

Before being processed in a pneumatic separator or classifier (13), a stream of cut tobacco, travelling to the separator on a conveyor (12), is passed through an opener (11) to open up tangled masses of tobacco that cannot be handled by the separator. The opener comprises carded rollers (1, 2, 3 and 4) having sequentially increasing peripheral velocities. Rollers (1,2 and 4) rotate in the same direction as each other, away from the conveyor, so that tobacco passes over the top of each roller, whereas roller (3) rotates in the opposite direction. The carding pins on rollers (1, 2 and 4) are inclined 5° to the normal, in the direction of rotation. The pins on roller (3) are inclined at 30°, also in the direction of rotation, so as to trap the tobacco as it is moved around underside of the roller.

4 Claims, 3 Drawing Sheets

TOBACCO PROCESSING METHOD AND APPARATUS

This invention relates to tobacco processing, and in particular a method and apparatus for opening tobacco for presentation to a separator or classifier.

Cut tobacco is usually derived by separate processing of the mid rib or stem of the tobacco leaf, and the lamina section of the leaf. The stem and lamina section may be detached from each other manually or by a threshing process. The stem is not constant in size and has small veins running from it, that pass into the lamina section of the leaf. Existing leaf preparation methods do not fully separate the veins and small stems from the lamina. Consequently, the material called lamina and presented for cutting contains a quantity of residual stem and veins, which will be cut with the lamina.

In cut form, these residuals are small hard pieces, slithers and needles mixed and embedded in a tangled matrix of long cut lamina strands. The presence of these residuals in cigarette tobacco is undesirable because they reduce the quality of the finished cigarette and the efficiency of cigarette manufacture. The undesirable particles are often referred to as objectionable tobaccos.

Objectionable tobaccos also exist, for example, in the separately processed stem after it has been cut. But this cut stem product is not entangled and pneumatic separation using, for example, devices as disclosed in EP-A-0511257, is able to remove a large proportion of the objectionable tobacco. On the other hand, attempts to use pneumatic separation to remove objectionable tobaccos from cut lamina have not been successful because a large proportion of the objectionables are trapped in the tangled strands of the cut lamina and do not have the opportunity to drop out in the pneumatic separator.

Cigarette making machines may also include a winnowing system to remove objectionable tobaccos prior to the formation of the cigarette.

Before being fed to the cigarette making machine, the cut lamina is combined with cut tobacco produced by a number of different processes. When combining the tobaccos, there is an opportunity for residual objectionable tobaccos to become entangled in the strands of cut lamina. This increases the difficulty of separating objectionables at the winnower and in consequence, these winnowing systems are of limited effectiveness. For example, if a winnowing system is set to remove 3% of total product, it is likely to remove about 1.5% objectionables and 1.5% non-objectionables and to leave 40 to 50% of the original input of objectionables in the tobacco presented for cigarette manufacture.

When tobacco for cigarette manufacture is composed of separately processed cut lamina and cut stem, the likely level of objectionable tobaccos is in the range of 1 to 6% of the total product, and a significant proportion of the objectionables are due to stem and vein residuals in the lamina presented for cutting. The expected level of residuals in the lamina presented for cutting depends on the method and quality criteria applied during detachment of the stem from the lamina, usually via a threshing process. Typically, the target level of residuals is 1 to 3.5%. The higher the permitted level of residuals, the more gentle the threshing process. While resulting in a higher level of potentially objectionable residues, the gentler threshing process also produces more larger pieces and fewer smaller pieces of detached lamina. This results in less wastage and more economic use of the lamina.

In some parts of the world it is customary not to thresh and not to detach the lamina from the stem. Consequently, the whole leaf is presented for cutting. Cut whole leaf will contain an increased level of objectionable tobacco particles (typically over 16%) because the stem has been cut with the lamina. Moreover, the cut lamina strands will be longer and more entangled than those produced from threshed lamina.

If a way can be found to remove objectionables from cut lamina and cut whole leaf more effectively, the potential benefits are:

1. A relaxation of the threshing stem residual criteria, giving more economic use of threshing systems and of detached lamina;
2. An improvement in finished cigarette quality;
3. An improvement in cigarette manufacturing efficiency and costs; and
4. Potential recovery of objectionable tobaccos that can be reprocessed into a non-objectionable form and re-used in a manner which contributes rather than detracts from final cigarette quality and manufacturing costs.

Pneumatic separation such as that in EP-A-0511257 and EP-A-0353261 and GB-A-2157411, is achieved by lifting and removing good product and permitting objectionable product to drop out to a reject location. For illustrative purposes, it is assumed that a pneumatic separator consists of a chamber in which there is an air stream directed vertically upwards and that product to be separated is introduced into the chamber in a substantially horizontal direction part way up the vertical chamber. When a mixture of good and objectionable product is presented into a moving air stream, those particles having a terminal velocity greater than the velocity of the air stream will not be supported by the air stream and will drop downwards. Those particles having a terminal velocity less than the air stream velocity, will be accelerated upwards with the air stream.

The terminal velocity of a particle is dependent on its mass, shape, size and orientation to the air stream. The greater the difference in terminal velocity between the product desired to be accepted (good product) and desired to be rejected (objectionable) the easier it is to pneumatically separate the particles.

Tests to determine the terminal velocities of a sample of tobacco have indicated:

| Particle Type | Terminal Velocity Meters/Sec | Desired Accept or Reject |
|---|---|---|
| Free stands of cut lamina | 0.7 to 2.3 | Accept |
| Tangled bunches of lamina | 1.6 to 2.3 | Accept |
| Large pieces of objectionable stem | 1.9 to 3.6 | Reject |
| Slithers of small cut stem/vein | 1.6 to 1.8 | Reject |
| Crosscut "Birdseyes" from small stem | 1.6 to 2.0 | Reject |

The quoted terminal velocities are illustrative only since they will vary with the tobacco type as well as with the particle type.

If a pneumatic separator having a uniform air velocity of 1.8 meters/second were presented with the materials in the above table, then the system would be expected to accept as good the free strands of cut lamina, the slithers of cut small stem and most of the cross cut birds eyes from small stem. It would drop out as objectionable heavy particles the large pieces of objectionable stem, a large proportion of the tangled bunches of cut lamina and a small proportion of the small stem birds eyes. Hence, accepted product would be expected to contain significant quantities of tobacco that it is desired to reject and the rejected product is expected to contain significant quantities of tobacco that it is desired to accept.

In a test situation, using a pneumatic separator set at 1.8 to 2 meters/sec airstream velocity to classify cut whole tobacco from a feed stock of 280 kg believed to contain 28 kg of objectionable tobacco desired to reject, the actual measured quantity of "heavies" reject was 108 kg. The rejected material was mainly made up of tangled bunches of cut lamina with objectionable stem pieces embedded in it. The implication is that if all objectionable material had been rejected, then 80 kg or 31% of good material was also incorrectly rejected.

In the ideal situation, presentation of material into the pneumatic separator would be in a form in which no cut lamina strands were tangled, no objectionable tobaccos were trapped in tangled acceptable tobacco and all acceptable product was presented as straight individual strands. Referring to the above Table, presentation in the described situation would cause the tobacco it is desired to accept to have terminal velocities in the range of 0.7 to 1.6 meters/sec and tobaccos it is desired to reject to have terminal velocities in the range of 1.6 to 3.6 meters/sec. Hence if the air stream in the pneumatic separator were set to 1.6 meters/sec then, theoretically, the accepted product would contain very little objectionable product and the rejected product would contain very little acceptable product.

It has been proposed to use carded rollers for metering tobacco flow (EP-A-0307070) and separating tobacco into different length strands for different grades of cigarettes (GB-A-2215578). However it has not been known hitherto to use carded rollers to open tangled masses in the feed to a tobacco separator to increase the efficiency of the separator prior to the generation of a mixture of cut lamina and cut stem.

According to the present invention there is provided a method of preparing cut tobacco for presentation to a separator wherein tangled strands of cut lamina are passed over at least two carded rollers rotating in the same direction but at sequentially higher surface velocities, so that the tobacco is at least partially untangled before being fed to the separator.

As the cut tobacco is conveyed from one carded roller to another carded roller having an increased surface velocity, the rate at which a leading portion of a tangled bunch of strands is advanced, relative to the rate at which a trailing portion of the bunch is advanced, is increased so that the distance between the leading and trailing portions is extended in the said direction. As a result of the extension, the tangled strands forming the bunches become straighter and more separated. In a preferred embodiment, the extension of the tangled bunch is sufficient to sever excessively long strands of cut lamina so that only strands having a length below a predetermined upper limit are fed to the separator.

A preferred apparatus for performing the method includes first and second intermeshed carded rollers, the downstream roller conveying the cut lamina at a greater rate than the upstream roller. Preferably, a reaction member is located above the throat between the two rollers such that a strand of cut lamina being stretched between the two rollers reacts with the member, the reaction severing the strand if the reaction force exceeds a predetermined level.

Advantageously the apparatus comprises a third or a third and fourth carded roller downstream of the first and second carded rollers, each having a higher surface velocity than the preceding roller. The third and fourth rollers may rotate in the same direction as the first and second rollers, or more preferably the third and fourth rollers rotate in different directions to each other. In that situation, the third roller preferably rotates in the opposite direction to the other rollers.

One embodiment of the present invention will now be described, by way of example only, with reference to the accompanying figures in which.

Figure 1:
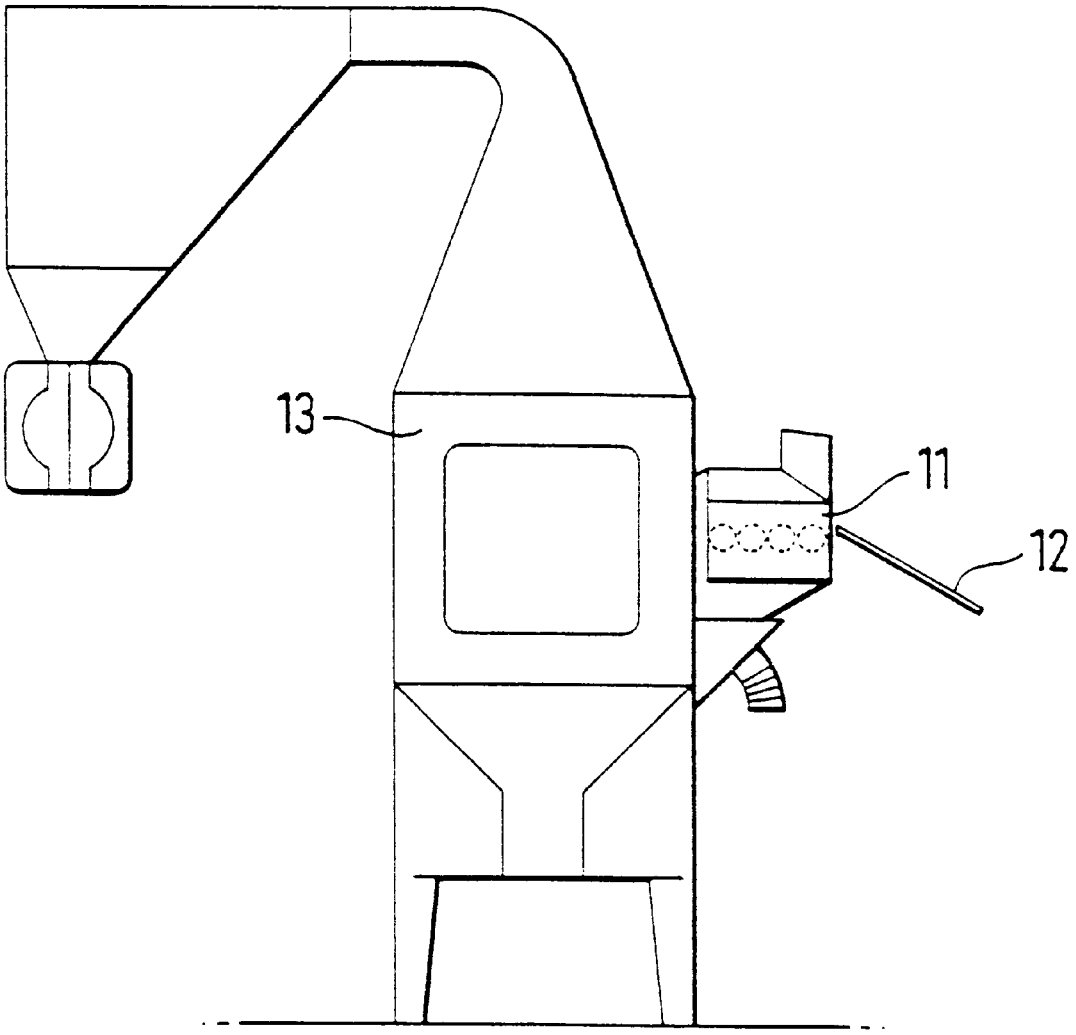
FIG. 1 shows schematically a carded roller tobacco opener of this invention positioned to feed into a pneumatic separator.

Referring to FIG. 1, there is shown a multi-roller tobacco opener 11 arranged to open tobacco products, typically whole cut leaf, which are fed by a conveyor 12 directly into a pneumatic separator 13 (also called a classifier). The opener 11 comprises a sequence of four carded rollers 1,2,3,4, as shown in more detail in FIG. 2.

Figure 2:
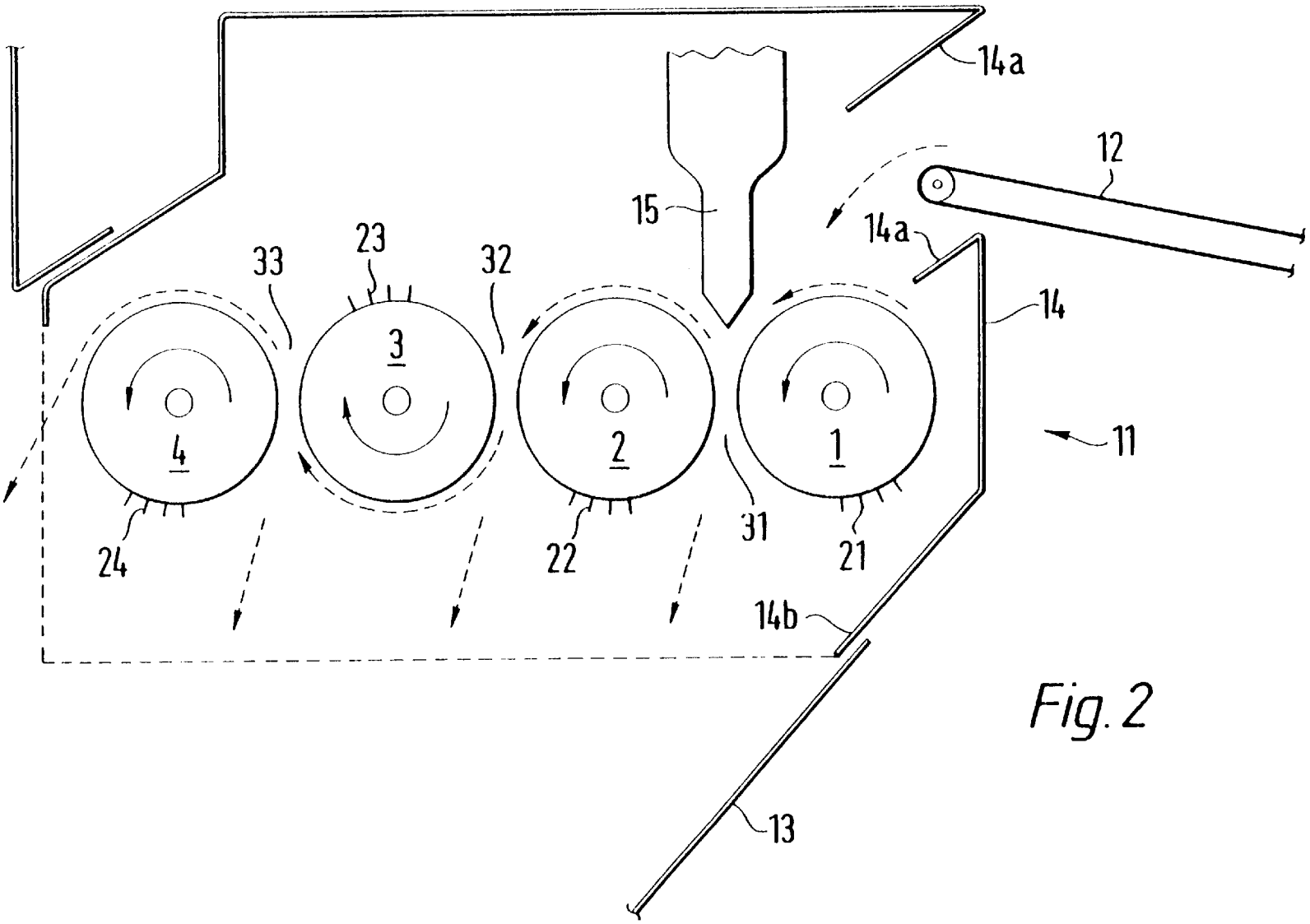
FIG. 2 is a schematic cross-section of a carded roller opening system.

Referring to FIG. 2, the opener comprises four carded rollers, that is rollers whose circumferential surfaces support outwardly directed carding pins. For convenience the rollers are mounted in a common frame with their rotational axes in the same horizontal plane (not shown), and the frame is located within a housing 14. The opener 11 is located over the inlet chute of the separator 13 to intercept tobacco being fed into the separator by the conveyor 12. The housing has upper guide surfaces 14*a* to direct tobacco from the conveyor onto the roller system, and lower guide surfaces 14*b* to ensure that all tobacco passing through the roller system enters the separator.

By use of appropriately geared transmission systems, such as toothed drive belts, the rollers can be driven at different rotational speeds by a single power source, such as an electric motor (not shown), mounted on or adjacent to the frame.

The rollers are typically about 1500–2000 mm in length and of diameter, including pins, of about 150–200 mm. The dimensions may be varied to suit the feed rate appropriate to the separator. The pins typically are mounted on the rollers so that they have a height above the roller surface of around 10–15 mm. The pins may upright (normal to the roller surface) or inclined to the normal, typically inclined in the direction of rotation. The inclination may range from 0–60°, preferably 0–30°.

Figure 3:
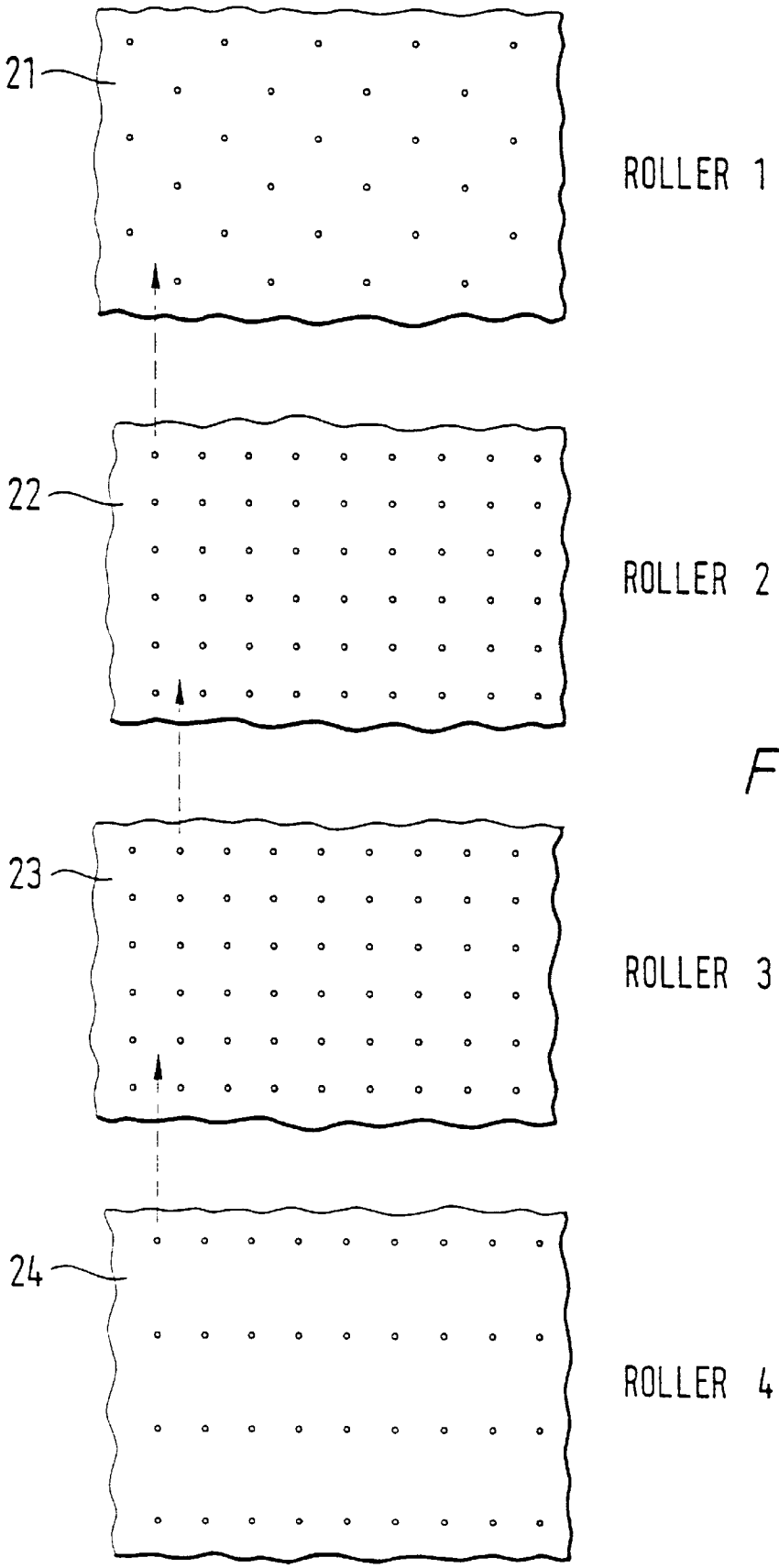
FIG. 3 shows fragmentary views of the pin configurations of the carded rollers of FIG. 2.

The pins are distributed evenly over the surface of each roller, the density of the pins depending on the application. The gap between adjacent rollers is set so that the pins of adjacent rollers overlap and so that the end of the pins on one roller do not contact the surface of the adjacent roller. Usually a clearance of at least 3 mm between pin end and adjacent surface is desirable. The pins are also arranged so that the circle of rotation of the pins on one roller is staggered relative to the pins on the adjacent roller, so that on rotation of the rollers the pins intermesh. This can be seen more clearly in FIG. 3 showing a schematic distribution pattern (discussed in more detail below) for the pins on the rollers 1–4, the pin size and distribution not being to scale. As in any carding system, the tips of the pins are pointed, but it is desirable that they are not so sharp as to impale stem pieces.

The aim of the system is to open up tobacco masses, such as so-called birds nests. This converts tangled masses that would fall to the base of the separator (and require manual opening), or else would require the separator to be operated at inefficiently high air velocities, into more separated material that can be handled efficiently by the separator. Accordingly the rollers are rotated so that there is a progressive increase in surface velocity as tobacco moves through the system from the conveyor towards the separator. In a typical example the rollers 1, 2, 3 and 4 have surface velocities of about 45, 60, 145 and 230 m/sec respectively.

As the tobacco is picked up by the pins from the next roller in line, the increased velocity of the pins opens up tangled masses. In the simplest situation, the rollers all rotate in the same direction and transfer most of the tobacco across the top of the roller system. However in the preferred configuration, rollers 1 and 2 (closest to the conveyor) rotate in the same direction as each other to carry incoming tobacco towards the separator, while rollers 3 and 4 rotate in opposite directions to each other. Preferably roller 3 is rotating in the opposite direction to roller 2. This is the situation shown in FIG. 2.

The path of tobacco through the system of FIG. 2 is shown by broken arrows. Tobacco entering the system falls onto roller 1 and is carried towards roller 2 through a gate formed by reaction bar 15 positioned above the throat formed between rollers 1 and 2. The pins of roller 2 pick up the tobacco and carry it on to roller 3. In this configuration roller 3 rotates in the opposite direction. Therefore it carries the tobacco around its underside to transfer to roller 4, before the latter delivers the tobacco into the separator. To perform the desired transfer functions it is necessary that the pins on rollers 1, 2 and 4 release the tobacco easily while the pins on roller 3 must retain the tobacco during transfer. We have found that efficient transfer is achieved when the pins on rollers 1, 2 and 4 are inclined at 5° to the normal in the direction of rotation, whereas the pins on roller 3 are inclined at 30° to the normal in the direction of rotation.

The density and distribution pattern of the pins also plays a role in efficient transfer and opening. An effective combination is shown in FIG. 3. On roller 1 the rows of pins are spaced at about 10 mm intervals circumferentially. Along the length of the roller the pins are spaced at about 20 mm intervals, but adjacent rows are staggered so that the circumferential spacing of pins is also 20 mm. On rollers 2 and 3 the pins are positioned at the intersections of an approximately 10×10 mm grid. Roller 4 retains the lengthwise spacing of rollers 2 and 3, but circumferentially the rows of pins are spaced at 20 mm intervals.

The pins on rollers 2, 3 and 4 are preferably positioned so as to maintain a common overall diameter despite the different inclinations. Accordingly the length of the pins on roller 3 (as opposed to the height above the roller surface) is greater than on rollers 2 and 4. On roller 1 it may be appropriate to provide heavier duty pins as in practice they receive a greater load of tobacco than the other rollers. For example while pins of 14 swg are suitable for rollers 2, 3 and 4, pins of 13 swg may be more suitable for roller 1. Also it may be of assistance for the pins on roller 1 to be higher than on the other rollers, for example 12.5 mm above the roller surface, against 11 mm for the other rollers.

The arrangement of the pins on the rollers will allow some strands and particles to fall between the rollers. Since each roller has a progressively higher surface speed, the leading part of a tangled bunch of tobacco in contact with a succeeding roller is drawn away more quickly than the trailing part of the bunch in contact with the preceding roller. Consequently, as tobacco passes from roller to roller, the extent of tangle reduces and strands become more separated and straighter. Variations in the pin sizes and configurations; the relative roller surface speeds; the gaps between rollers; and the direction of rotation of the rollers; together determine the rate at which tangles are opened and become individual strands.

When opening cut lamina produced from threshed lamina it is normally desirable that strands are not broken and that new small particles of cut lamina are not generated. However, there are also circumstances where some strands may be considered too long. This is particularly so with cut whole leaf but can arise due to changes in the threshing method. Also, with cut whole leaf, some of the stem cut with the leaf may be attached to a long strand of cut lamina. The length of long strands can be reduced by severing the strands, either by increasing differential roller speeds to further stretch the strands and/or by inclining the angled pins further away from the radial direction.

Breaking of long strands and detachment of attached stem is encouraged by fitting reaction bars above the junction of two rollers as described above. In the configuration shown, a strand in contact with rollers 1 and 2 is stretched against the reaction bar 15.

In use of the system shown in FIGS. 2 and 3, the tobacco strands are fed in from conveyer 12 on to roller 1 (rotating anticlockwise as seen in FIG. 2) and the pins 21 engage the incoming tobacco and move it anticlockwise into meshing region 31 where the pins 22 of roller 2, also moving anticlockwise, engage the tobacco strands. The reaction bar 15 restricts the amount of tobacco fed into the meshing region 31 and reduces 'gulping' of large clumps. The relative motion of the rollers 1 and 2 stretch the tangled tobacco clumps until the clump is released from pins 21. The stretched entangled tobacco is then moved over the top of roller 2 into the second meshing region 32. Long strands and particles will not be picked up by the pins 22 and will fall through the gap between the rollers 1 and 2 directly into the chute of the separator 13, or onto guide surface **14*b* placed below the roller 1**.

In the second meshing zone 32, the motion of the meshing sets of pins 22 and 23 is in the same direction (as roller 3 is turning clockwise) but pins 23 are moving at a higher speed. The effect of this is that pins 23 engage strands of the clump and stretch it between the pins 22 and 23 before the pins 22 disengage from the clump. The clump is then moved by the appropriately inclined pins around the bottom of roller 3 to the third meshing region 33 while the loose strands and particles fall through the gap into the separator chute beneath the rollers. The angle of the pins 23 is higher than the pins on the other rollers to provide a firmer engagement with the clump as it moves under the roller.

The pins of roller 4 are rotating in an anticlockwise direction but at a higher speed than those of roller 3. Therefore in the third meshing region the pins 24 engage the tobacco clump and, while it is moving in the same direction, stretches it between the pins 23 and 24. Loose strands will fall through the gap into the chute beneath the rollers or otherwise the appropriately inclined pins 23 will carry the tobacco over the top of the roller 4 and allow it to disengage and drop into the chute.

The opening up of tangled clumps by the rollers feeds the loose strands, particles and loosened clumps of tobacco into the separating process, and maximises the ability of the separator to discriminate between acceptable and rejectable tobacco. The opening system may be used with pneumatic separators, fluidised, semi-fluidised, optical or electro-static separators.

The following Table shows test results illustrating the effect of tobacco opening on the performance of the classifier. In this instance, the fed stock was cut threshed lamina with an expected objectionable content of 1.6 to 2.6%. In the table "Dropout" is the material rejected by the classifier.

| | % Dropout | | |
|---|---|---|---|
| Flow Rate Kg/hr | A Opener & Classifier | B Classifier Only | Relative Increase |
| 500 | 2.0 | 0.98 | 2.04 |
| 750 | 2.0 | 0.76 | 2.63 |
| 1000 | 1.9 | 0.58 | 3.27 |
| 1250 | 2.1 | N.A. | |

It can be seen from the table that using the classifier only (that is without an opener) the percentage of drop out decreased as the input mass flow increased, while in the situation where the opener was in use, the drop out percentage was both higher and near constant. This illustrates the effect the opener has of enabling more effective separation of objection particles.

In anther test a blend containing cut threshed lamina was separated into two batches. One batch was passed to a cigarette maker in the normal method. In this instance, from a feed stock believed to contain 3.08% objectionable tobacco, a total of 1.42% (14.2 kg) was removed by the winnower built into the cigarette making machine.

The second batch of tobacco had the same expected level of objectionables at the input condition. This batch was passed via a tobacco opener of this invention to a pneumatic separator (specifically an LFC classifier). At the classifier 18.1 kg or 1.81% of objectionables were removed. The product was then fed to the same cigarette maker as the first batch. At the cigarette maker, a further 9.6 kg or 0.96% of winnows were removed.

On the assumption that the cigarette maker winnowing system only removed objectionable particles, then for the first batch the expected level of objectionables in the cigarette is 1.66% compared to the second batch where the opener and LFC were also used, and resulted in an expected level of objectionables in the cigarette of 0.31%.

I claim:

1. A method of preparing cut tobacco for presentation to a separator wherein tangled strands of cut lamina are passed over two carded rollers arranged to rotate in the same direction but at sequentially increasing surface velocities, so that the tobacco is at least partially untangled before being fed to the separator, the tobacco from the second carded roller being passed over third and fourth carded rollers downstream of the first and second carded rollers, each of the third and fourth carded rollers having a higher surface velocity than the preceding roller, and in which the third and fourth rollers are arranged to rotate in different directions to each other, and in which the third carded roller is arranged to rotate in the opposite direction to the other rollers.

2. Apparatus for opening tangled tobacco comprising first and second intermeshed carded rollers positioned across a flowpath for tobacco, the downstream roller of the first and second rollers conveying the tobacco at a greater rate than the upstream roller, third and fourth carded rollers downstream of the first and second carded rollers, each of the third and fourth carded rollers having a higher surface velocity than the preceding roller and in which the third and fourth rollers are arranged to rotate in different directions to each other, and in which the third carded roller is arranged to rotate in the opposite direction to the other rollers.

3. Apparatus according to claim 2, in which a reaction member is located above the throat between the two rollers such that tobacco being stretched between the two rollers reacts with the member, the reaction severing the tobacco strands if the reaction force exceeds a predetermined level.

4. Apparatus according to claim 2, in which pins provided on the first, second and fourth rollers are inclined at 5° to the normal in the direction of rotation and the pins on the third roller are inclined at 30° to the normal in its direction of rotation.

* * * * *